US006942096B2

(12) United States Patent
Kobayashi et al.

(10) Patent No.: US 6,942,096 B2
(45) Date of Patent: Sep. 13, 2005

(54) LIGHT SHIELDING FLANGE

(75) Inventors: Hajime Kobayashi, Tokyo (JP); Toshiyuki Ikariya, Hino (JP); Mitsuru Nagasaki, Choufu (JP)

(73) Assignee: Konica Corporation, Tokyo (JP)

( * ) Notice: Subject to any disclaimer, the term of this patent is extended or adjusted under 35 U.S.C. 154(b) by 122 days.

(21) Appl. No.: 10/639,193

(22) Filed: Aug. 11, 2003

(65) Prior Publication Data

US 2004/0033331 A1 Feb. 19, 2004

(30) Foreign Application Priority Data

Aug. 19, 2002 (JP) ..... 2002-237977

(51) Int. Cl.[7] ..... G03C 3/00

(52) U.S. Cl. ..... 206/416; 242/607; 242/608; 242/608.6; 242/614; 242/118.61

(58) Field of Search ..... 242/607, 118.61, 242/608, 608.6, 608.7, 614, 614.1; 428/66.6; 206/414, 416, 415

(56) References Cited

FOREIGN PATENT DOCUMENTS

| | | |
|---|---|---|
| EP | 0 692 734 A1 | 1/1996 |
| EP | 1 016 908 A2 | 7/2000 |
| EP | 1 132 769 A2 | 9/2001 |
| EP | 1 260 857 A1 | 11/2002 |

*Primary Examiner*—Alexander S. Thomas
(74) *Attorney, Agent, or Firm*—Lucas & Mercanti, LLP

(57) ABSTRACT

Paired light shielding flange members, each having:

a hollow cylindrical boss section to be inserted into a core around which a photosensitive material has been wound, wherein a plurality of rip sections are formed on the exterior surface of the cylindrical boss section parallel with an axis of the boss section, and an interior surface portion of rib is grooved in parallel with the axis of the hollow cylindrically boss section, and a flange section, integrated concentrically with the hollow cylindrical boss section, to prevent the edge of photosensitive material from being exposed to light.

10 Claims, 4 Drawing Sheets

LIGHT SHIELDING FLANGE

BACKGROUND OF THE INVENTION

The present invention relates to paired light shielding flange members which are fitted into both ends of a hollow cylindrical core on which a rolled type photosensitive material has been wound.

Hitherto, rolled type photosensitive materials have been packed to conform to so-called ambient light loadable packages. Ambient light loadable packages are structured in such way that, a wide and long photosensitive material is rolled up on a hollow cylindrical core, and light shielding flange members are fitted into both ends of the core, after a light shielding leader, which is wider than the rolled-up photosensitive material, is adhered to the end of the rolled-up photosensitive material, after which the light shielding leader is wound up onto the rolled-up photosensitive material, so that the peripheral sections of the light shielding flange members, fitted into both ends of the core, are covered by the light shielding leader, resulting in light shielded packaged photosensitive material which is capable of being loaded into a magazine of a photographing apparatus in ambient light.

When the rolled type photosensitive material packaged to conform to ambient light loadable package (hereinafter referred to simply as ambient light loadable package), is employed, the end of the light shielding leader is pulled slightly, next the ambient light loadable package is loaded into an exclusive magazine of a photographing apparatus in ambient light, then the magazine is loaded into the photographing apparatus for use. Accordingly, light shielding is very important for ambient light loadable packaged photosensitive material.

For this purpose, when the light shielding leader is wrapped on the rolled-up photosensitive material to make the light shielded package, in order to prevent light from entering the edges of the photosensitive material, the light shielding flange members are fitted to both end sections of the rolled type photosensitive material.

The thickness of the employed light shielding flange member depends upon the type of magazines to be loaded into the photographing apparatus, being classified into two types, a thin type of 0.3 to 1.0 mm, and a thick type of 2.0 to 4.0 mm. Of the light shielding flange members, the thick type can be produced by a normal injection molding (refer to the handbook of plastic processing technology, pages 427–647, Society of Polymer Science, Japan). The thin type can be produced by a normal vacuum molding, pneumatic molding (refer to the handbook of plastic processing technology, pages 945–959, Society of Polymer Science, Japan), and injection molding (refer to the handbook of plastic processing technology, pages 427–647, Society of Polymer Science, Japan).

After being loaded into the magazine, the magazine is loaded into the photographing apparatus. There are two cases of usage of the photosensitive material in the magazine. One is that all of the photosensitive material in the magazine is completely used up, and the other is that the use of the photosensitive material in the magazine is discontinued halfway and is changed to another type of photosensitive material. For the latter case, the magazine is firstly unloaded from the photographing apparatus, a light shielding leader, which is wider than the photosensitive material, is spliced onto the end of the photosensitive material which slightly appears from the magazine, after which the photosensitive material in the magazine is rewound, and thereby, the light shielding leader is forced to back into the magazine, and is wound around the photosensitive material, and also around the circumferential sections of the flange members fitted into ends of the core, resulting in a light shielded package. Finally, the light shielded package of the photosensitive material is pulled out from the magazine and is stored for the next use.

Due to usage of ambient light loadable packaged photosensitive material as described before, the user requires that the light shielding flanges used therein meet the following functions.

(1) In order to perform complete light shielding, when a hollow cylindrical boss section of the light shielding flange section is inserted into the core, the hollow cylindrical boss section must fit firmly into the hollow cylindrical section of the core.

(2) In order to stably supply or rewind the photosensitive material from or into the magazine, an inner surfaces of the hollow cylindrical boss sections of the light shielding flange members must be fixed to an inner shaft of the magazine without play or back-lash, and still further, must be easily fixed or detached.

(3) In the case when the photosensitive material in the magazine is discontinued halfway and another type of photosensitive material is employed, a light shielding leader which is wider than the photosensitive material is spliced onto the end of the photosensitive material which slightly appears from the magazine, after which the photosensitive material in the magazine is rewound, and thereby, the light shielding leader is forced to enter the magazine, and is wound around the photosensitive material, and also around the circumference of the flange members fitted into the core, and the light shielded package is made again in the magazine and when the light shielded package is taken from the magazine, that is, when the hollow cylindrical boss section of the flange member having the photosensitive material is pulled from the inner shaft of the magazine, the light shielding flange member must not be separated from the core.

Concerning the functions required of the light shielding flange member, the following characteristics apply to both the thicker and the thinner type light shielding flange members.

In the case of the thicker type light shielding flange member, concerning the functions shown in (1) to (3), injection molding method can be employed for its production, and in particular, for (1), ribs are formed on the periphery surface of the hollow cylindrical boss section.

In the case of the thinner type light shielding flange member, concerning the function shown in (1), it is processed in such a way that a vinyl tape is wound on the outer periphery surface of the hollow cylindrical boss section. However, for recycling after use, the vinyl tape must be removed, and further, it is troublesome to wind the tape onto the outer periphery surface of the hollow cylindrical boss section, which are drawbacks. Concerning the functions shown in (2) and (3), they are processed in such a way that the light shielding flange member is made by a vacuum molding or a pneumatic molding method having higher dimensional accuracy, but at lower productivity and higher cost, which are also drawbacks.

As countermeasures to the drawbacks of the thin type light shielding flange member, described above, a thin typed light shielding flange member made by the injection molding method is disclosed in TOKKAIHEI 8-62783 which has a 0.3–1.0 mm flange, and ribs are provided on the outer circumferential surface of the hollow cylindrical boss section of the light shielding flange member, in order to make firm contact between the hollow inner cylindrical section of the core and hollow cylindrical boss section of the light shielding flange member. However, though production cost by the injection molding method is more favorable than production cost by the vacuum molding or pneumatic molding method, the thin type light shielding flange member disclosed in TOKKAIHEI 8-62783 is not sufficient to counter the above-described functions (1)–(3) which are required of the light shielding flange member, because of the following reasons.

(1) Since the thickness of the section where the rib is provided on the hollow cylindrical boss section is different from the thickness where there is no rib, a change of thickness results during the injection molding process, and thereby the thickness of the hollow cylindrical boss section is not uniform, and further, the form of the produced hollow cylindrical boss sections is also not uniform. When such light shielding flange member is inserted into the hollow cylindrical section of the core of the rolled type photosensitive material, the connection between the hollow cylindrical boss section and the core is not secure, and thereby they may become separated, during the production of the ambient light loadable package.

(2) Since the thickness of a section where a rib is provided on the hollow cylindrical boss section is different from the thickness of a section where there is no rib, when the inner shaft of the magazine is inserted into a hollow section of the light shielding flange member, the hollow cylindrical boss section rarely expands uniformly, resulting in abnormal setting of the ambient light loadable package into the magazine.

(3) When the inner shaft of the magazine has been firmly inserted into the hollow cylindrical boss section of the light shielding flange member, the following situation may happen. That is, when the photosensitive material in the magazine is changed at the halfway point to another type of photosensitive material, a light shielding leader which is wider than the photosensitive material, is spliced onto the end of the photosensitive material which slightly appears from the magazine, after which the photosensitive material in the magazine is rewound, and thereby, the light shielding leader is forced to enter the magazine, and is wound around the photosensitive material, and also around the circumferential sections of the flange members fitted into both ends of the core, resulting in a light shielded package, and finally when the light shielded package of the photosensitive material is removed from the magazine, that is, when the inner shaft of the magazine is removed from the hollow cylindrical boss section of the light shielding flange member, the light shielding flange member is also removed from the core, resulting in undesirable exposure of the photosensitive material.

(4) When an unstable supply of resin occurs during injection molding, it is very difficult to obtain uniform flatness of flange section.

If such a flange is used for packaging of the photosensitive material, the light may enter either or both side surfaces of the rolled photosensitive material, resulting in an ineffective light shield.

Under the conditions mentioned above, expected is development of a light shielding flange member, wherein the hollow cylindrical boss section of the light shielding flange member is fixed in the hollow cylindrical inner section of the core without using supplementary parts, the inner shaft of the magazine is fixed without loosening and is easily removed from the inner wall of hollow section of the hollow cylindrical boss section of the light shielding flange member, the production cost is inexpensive, and the production can be stably achieved.

SUMMARY OF THE INVENTION

The present invention was achieved in view of the above-described conditions, and its objective is to provide a thin type light shielding flange member, produced by injection molding method, wherein the hollow cylindrical boss section of the light shielding flange member is fixed into the hollow cylindrical inner section of the core without using supplementary parts, the inner shaft of the magazine is fixed without loosening and is easily removed from the inner side of hollow section of the hollow cylindrical boss section of the light shielding flange member, the production cost is inexpensive, and the production can be stably achieved.

The objective of the present invention is attained by the following structures.

Structure 1

Paired light shielding flange members, having a hollow cylindrical boss section which fits into both ends of hollow interior of a hollow cylindrical core around which a rolled type photosensitive material is wound; and a concentric flange integral with the hollow cylindrical boss section, wherein a plurality of rib sections having no grooves on their rear surfaces are arranged on the peripheral surface of the hollow cylindrical boss section, being parallel to the axial center of the hollow cylindrical boss section.

Structure 2

The light shielding flange member described in structure 1, which is produced by injection molding using a die having 3–6 submarine gates which are arranged near the center of the inner peripheral surface of hollow cylindrical boss die section, and further the thickness of the light shielding flange member is 0.3–0.5 mm.

Structure 3

The light shielding flange member described in structure 1 or 2, wherein perpendicularity of a peripheral area of the flange compared to the base section of the hollow cylindrical boss section is −0.1–0.3 mm.

BRIEF DESCRIPTION OF THE DRAWINGS

FIG. 1(*b*) is an exploded schematic perspective view showing an example of the conformation of the ambient light loadable package of a rolled type photosensitive material.

DETAILED DESCRIPTION OF THE PREFERRED EMBODIMENTS

The preferred embodiments of the present invention will be described while referring to FIGS. 1–4, however, this invention is not limited to these embodiments.

Figure 1:
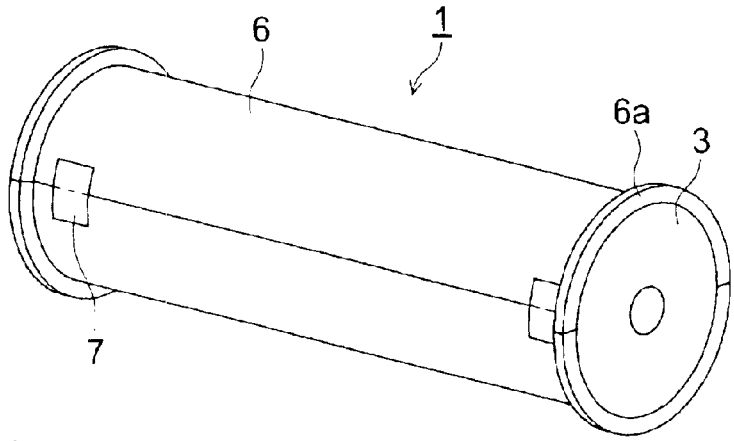
FIG. 1(*a*) is a schematic perspective view showing an example of the conformation of the ambient light loadable package of a rolled type photosensitive material.
Figure 1:
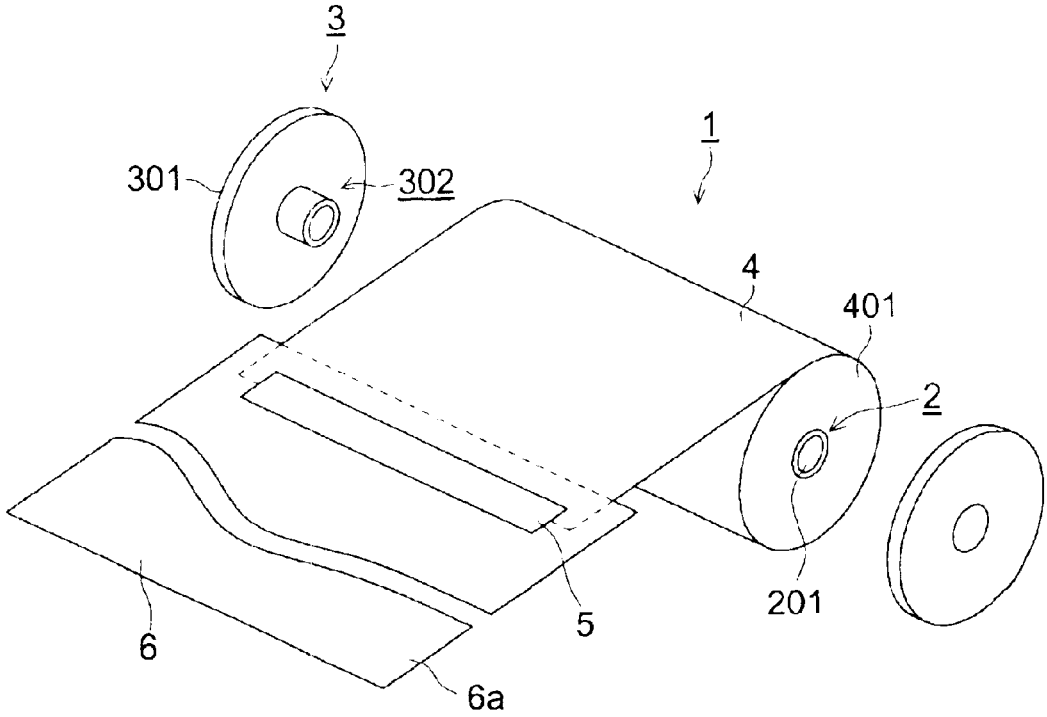

FIGS. 1(*a*) and 1(*b*) are schematic perspective views showing an example of the conformation of the ambient light loadable package of a rolled type photosensitive material. In FIG. 1(*b*), numeral 1 shows the ambient light loadable packaged photosensitive material wherein light shielding flange members 3 are fitted onto both ends of rolled type photosensitive material 4 wound around hollow cylindrical core 2, and wherein the rolled type photosensitive material 4 is light tight by use of light shielding leader 6, which is wider than rolled type photosensitive material 4 and is spliced by adhesive tape 5 onto the end of rolled type photosensitive material 4.

Since ambient light loadable packaged photosensitive material 1 is loaded into a magazine in ambient light, light shielding is very important. Therefore, in order to prevent light from entering both sides of rolled type photosensitive material 4, light shielding flange members 3 are attached on both sides of rolled type photosensitive material 4.

Light shielding flange member 3 is composed of hollow cylindrical boss section 302 which fits into hollow sections 201 on both ends of core 2, and light shielding flange 301 which comes into close contact with side surface 401 of rolled type photosensitive material 4 and shields side surface 401 from ambient light. Flange section 301 is integrated with and concentric with hollow cylindrical boss section 302. The diameter of flange 301 is preferably 2–5 mm greater than the diameter of the rolled type photosensitive material.

When light shielding leader 6 is wound around rolled type photosensitive material 4, section 6*a* which is wider than rolled type photosensitive material 4, of light shielding leader 6, covers the peripheral section of flange 301 of light shielding flange member 3, so that wider section 6*a* prevents light from entering the clearance between side surface 401 of rolled type photosensitive material 4 and flange 301. Numeral 7 is a piece of adhesive tape for splicing the end of leader 6 to itself.

Figure 2:
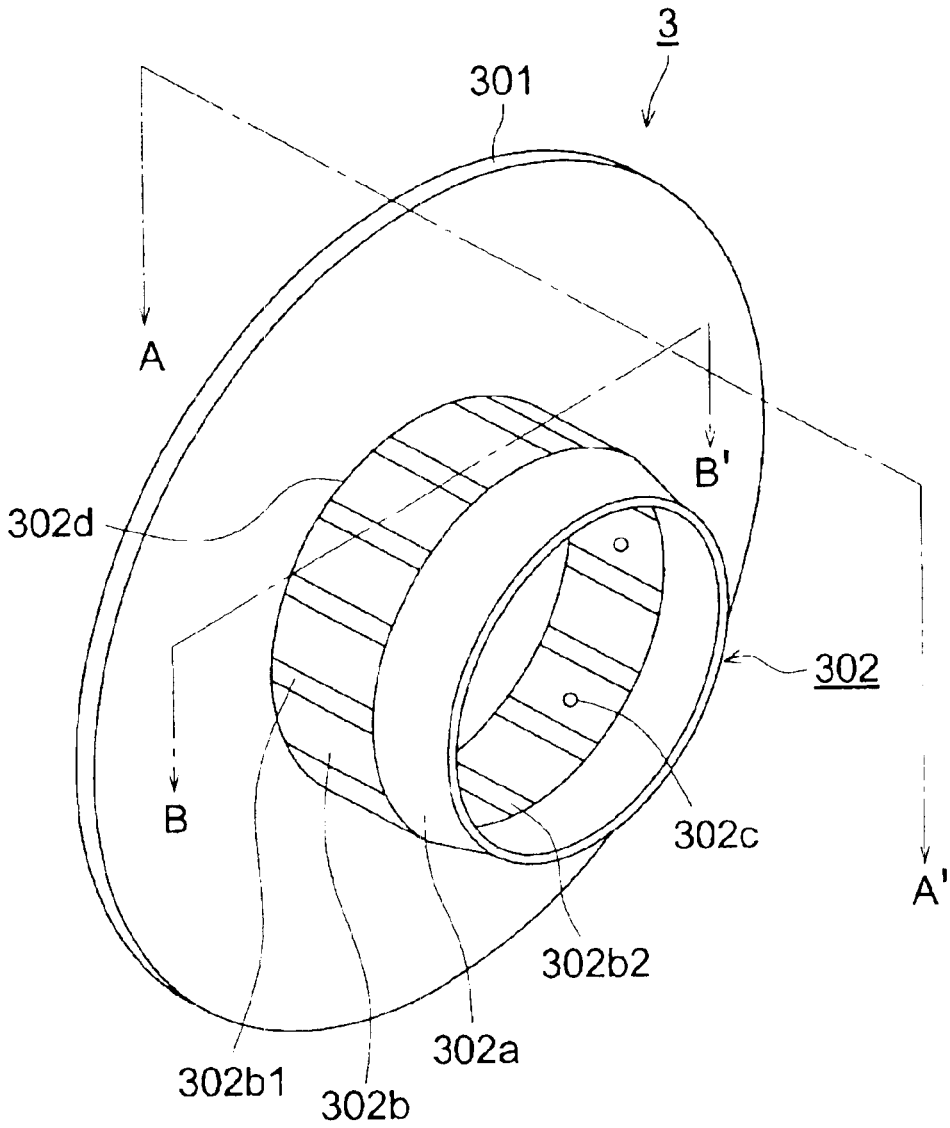
FIG. 2 is an enlarged schematic perspective view of a light shielding flange member shown in FIG. 1(*a*).

FIG. 2 is an enlarged schematic perspective view of the light shielding flange member shown in FIG. 1(*b*).

Light shielding flange member 3 is composed of hollow cylindrical boss section 302 and flange 301 which is integral with hollow cylindrical boss section 302. Hollow cylindrical boss section 302 has waist section 302*b* having the same external diameter as base section 302*d* of hollow cylindrical boss section 302, and also has tapered section 302*a* at the top of hollow cylindrical boss section 302, which allows hollow cylindrical boss section 302 to more easily enter the hollow section of core 2. On the peripheral surface of waist section 302*b*, arranged are interior surface grooved ribs 302*b*1, which come into contact with the inner surface of the hollow section of the core to fix light shielding flange member 3.

The number of interior surface grooved ribs 302*b*1 is preferably 8–10, from the view point of a tight fit of hollow cylindrical boss section 302 of light shielding flange member 3 into the inside of the hollow section of the core, and the strength of waist section 302*b*. Interior surface grooved ribs 302*b*1 are arranged parallel to the axial center line of hollow cylindrical boss section 302, from base section 302*d* of hollow cylindrical boss section 302 to the full length of waist section 302*b* excluding tapered section 302*a*.

Numeral 302*b*2 represents a grooved section of interior surface grooved rib 302*b*1. Numeral 302*c* represents a vestige of a position of the submarine gate of the metal mold which is used for producing light shielding flange member 3 by the injection molding method. The metal mold used for the invention is described later.

Figure 3:
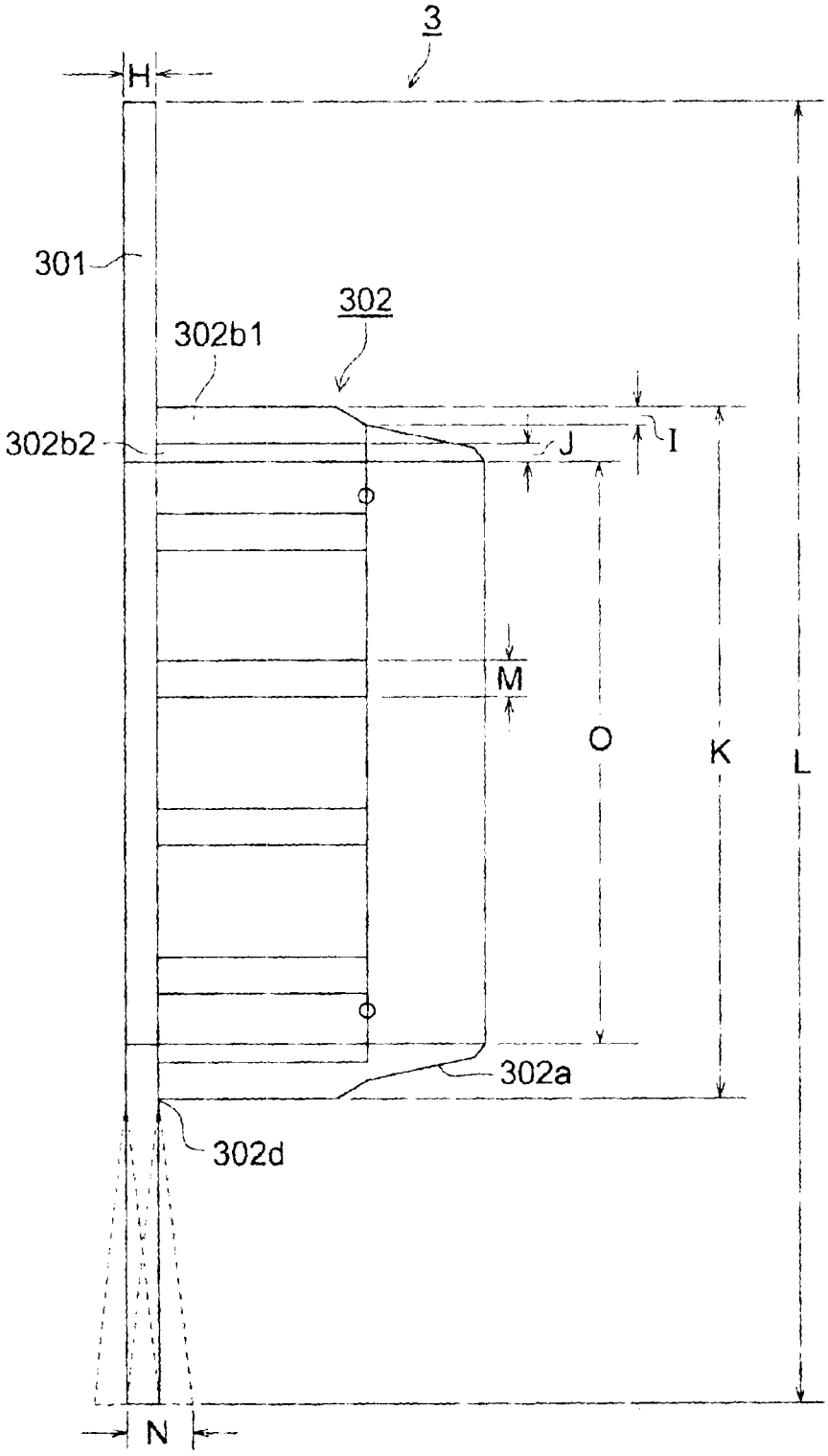
FIG. 3 is an enlarged schematic sectional view taken on line A–A' of the light shielding flange member shown in FIG. 2.

FIG. 3 is an enlarged schematic sectional view taken on line A–A' of the light shielding flange member shown in FIG. 2. In FIG. 3, symbol H represents the thickness of flange 301 of light shielding flange member 3. Thickness H is preferably 0.3–0.5 mm. In case of thickness H being less than 0.3 mm, it is sometimes impossible to obtain the necessary rigidity, depending on the type of the material used. In case of thickness H being greater than 0.5 mm, it is sometimes very difficult to load the ambient light loadable packaged photosensitive material depending on the type of the magazine. The thickness of light shielding flange member 3 is the same as that of flange 301, except for tapered section 302*a* of hollow cylindrical boss section 302. By providing grooved section 302*b*2, the thickness of interior surface grooved rib 302*b*1 can be the same as that of waist section 302*b* of hollow cylindrical boss section 302, and thereby it is possible to make the physical characteristics of hollow cylindrical boss section 302 uniform.

"I" represents the height of interior surface grooved ribs 302*b*1, preferably being 1.2–2.4 mm. In case of a height of less than 1.2 mm, the security between light shielding flange member 3 and the hollow section of the core becomes so loose that when the inner shaft of the magazine is removed, light shielding flange member 3 occasionally is also removed from the core simultaneously. In cases of height I being greater than 2.4 mm, the resistance of the hollow section of the core against the inner shaft of the magazine becomes so great that the inner shaft of the magazine cannot be fully inserted to the base of the shaft, or the flange can be deformed and its flatness cannot be kept.

Symbol J represents the height of grooved section 302*b*2, being preferably the same as the height of interior surface grooved ribs 302*b*1.

Symbol K represents the maximum external diameter of hollow cylindrical boss section 302, and maximum external diameter K is preferably 100.2–101.0% of the inner diameter of the hollow cylindrical core. In cases of maximum external diameter K being less than 100.2%, the fit between light shielding flange member 3 and the hollow section of the core deteriorates so much that when the inner shaft of the magazine is removed, light shielding flange member 3 may also be removed from the core at the same time. In cases of maximum external diameter K greater than 101.0%, when the inner shaft is inserted into the hollow section of the core, the flange may be deformed and cannot be flat.

Symbol L represents the diameter of flange 301, which is preferably 102–110% of the diameter of the rolled type photosensitive material. In cases of diameter L being less than 102%, the rolled type photosensitive material may be exposed to light. In cases of diameter L being greater than 110%, the ambient light loadable packaged photosensitive material may not fit into the magazine.

Symbol M represents the width of grooved section 302*b*2, which is preferably such that the thickness of interior surface grooved rib 302*b*1 is the same as that of flange 301, excluding tapered section 302*a* of hollow cylindrical boss section 302 of light shielding flange member 3.

Symbol N shows a curled range in which a surface of flange 301 deflects in direction to hollow cylindrical boss section 302 from base section 302*d*. Regarding base section 302*d* as the original point, deflection of flange 301 toward hollow cylindrical boss section 302 is "+" (positive), and the opposite, "−" (negative). Deflection scope N is preferably from −0.1 to +0.3 mm. In cases of less than −0.1 mm, the flange may be too easily removed from the side surface of the rolled type photosensitive material by an external force, resulting in detrimental light shielding. In cases of it being greater than +0.3 mm, the width of the peripheral section of the flange, which is covered by the light shielding leader spliced on the end of the rolled type photosensitive material, varies also resulting in detrimental light shielding. Further, when the light shielding leader is re-wound into the magazine, rolled type photosensitive material is too close against the flange, resulting in an abnormal take-up of the rolled type photosensitive material.

Symbol O represents an inside diameter of hollow cylindrical boss section 302. Since inside diameter O depends on the method of the inner shaft of the magazine being used, it is preferable to set inside diameter according to the inner shaft of the magazine being used.

Figure 4:
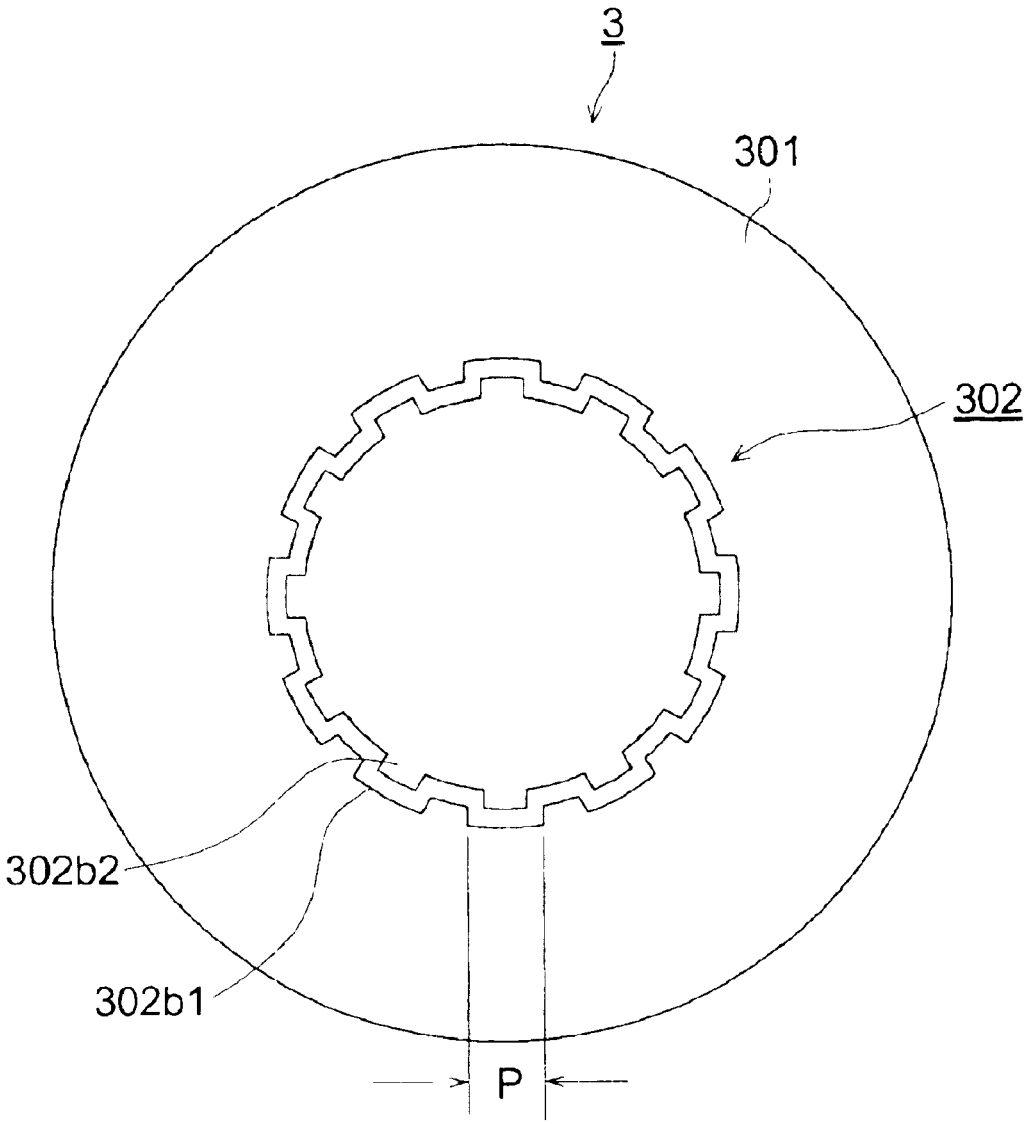
FIG. 4 is an enlarged schematic sectional view taken on line B–B' of the light shielding flange member shown in FIG. 2.

FIG. 4 is an enlarged schematic sectional view taken on line B–B' of the light shielding flange member shown in FIG. 2.

Symbol P represents the width of interior surface grooved rib **302*b*1, which is preferably 2.5–4.0 mm. In case of it being less than 2.5 mm, hollow cylindrical boss section 302 is uncertainly fixed into the hollow section of the core, and thereby, when the inner shaft of the magazine is removed, the light shielding flange member may also be removed. In cases of it being greater than 4.0 mm, when hollow cylindrical boss section 302** is forced into the hollow section of the core, the flange may be deformed, and cannot be flat.

The thickness of the light shielding flange member of the present invention shown in FIGS. 1–4, is 0.3–0.5 mm, which is very thin. Therefore, during production of the light shielding flange member by the injection molding method, when a melted resin is ejected into a cavity of the metal molding die, pressure loss is so great that the flow of the resin is greatly reduced, since the resin is quickly cooled while it flows into the farthest reaches of the cavity, and thereby the resin may not flow into the distal section. Accordingly, the metal molding die to be used is preferably a die in which the 3–6 pieces of submarine gates are arranged near the center (see FIG. 2) of the interior of the hollow cylindrical boss section in the die. Employment of such kind of metal molding die makes it possible to easily maintain the uniformity of the thickness and curling of the flange in the range of the present invention, to increase the contact between the flange and the side surface of the rolled type photosensitive material, to stabilize the covering width onto the flange when the light shielding leader is wound around the rolled type photosensitive material, to increase light shielding and reduce exposing light, and to produce the ambient light loadable packaged photosensitive material.

Further, since the thickness of the flange is very thin, when the die is opened, the flange of the light shielding flange member easily remains in the metal molding die. It is therefore, possible to perform more stable injection molding by providing one or more air inlet holes at the appropriate positions of the hollow cylindrical boss section or of the flange of the light shielding flange member in the metal molding die.

The following described effects can be better achieved by using a light shielding flange member whose peripheral surface of the hollow cylindrical boss section has a plurality of interior surface grooved ribs.

(1) On the hollow cylindrical boss section, since the thickness of the section where the interior surface grooved rib is provided, is nearly similar to the thickness of a section where the interior surface grooved rib is not provided, an unstable supply of the resin hardly occurs during injection molding, and thereby it is possible to more evenly produce a uniform thickness of the hollow cylindrical member. When the shape of the hollow cylindrical member can be stabilized, and when the hollow cylindrical boss section of the light shielding flange member is fitted into the inside of the core around which the photosensitive material is wound, the fixing of the hollow cylindrical boss section into the core can also be stable, resulting in easy production of an ambient light loadable package.

(2) On the hollow cylindrical boss section, since the thickness of sections where the interior surface grooved rib is provided, is nearly similar to the thickness of sections where the interior surface grooved rib is not provided, when the inner shaft of the magazine is inserted into the hollow section of the hollow cylindrical boss section, the hollow cylindrical boss section is expanded uniformly, resulting in easy insertion of the inner shaft of the magazine.

(3) Since the interior surface grooved ribs on the peripheral surface of the hollow cylindrical boss section are provided, the hollow cylindrical boss section of the light shielding flange member can be firmly fitted into the hollow cylindrical inner section of the core without using supplementary parts.

(4) When the photosensitive material in the magazine is changed to another type of photosensitive material when the magazine is half full, a light shielding leader is spliced onto the accessible end of the photosensitive material, after which the photosensitive material in the magazine is rewound, and thereby, the light shielding leader is forced to enter the magazine, and is wound around the photosensitive material, and also around the circumferential sections of the flange members fitted into both ends of core, resulting in a light shielded package, and finally when the light shielded packaged photosensitive material is removed from the magazine, that is, when the inner shaft of the magazine is removed from the hollow cylindrical boss section of the light shielding flange member, the light shielding flange member does not slip from the core, working it easier to change the rolled type photosensitive material to another type.

It is possible to produce the light shielding flange member of the present invention by the common injection molding method described on pages 427–647 of "Handbook of Plastic Processing Technology", edited by the Society of Polymer Science, Japan.

Concerning thermoplastic resin used for the light shielding flange member of the present invention, enumerated are polystyrene resin, acrylic nitrile-butadiene-stylene copolymer resin, polycarbonate resin, acrylic resin, polyamide resin, polyethylene resin, and polypropylene. Preferable among them is polystyrene resin having a melt flow rate of 15 g/10 min–25 g/10 min, and an elastic modulus in tension of 1800–3000 MPa.

Concerning coloring material of the thermoplastic resin used for the light shielding flange member of the present invention, preferable carbon blacks are oil-furnace carbon black, Ketjen carbon black, gas-furnace carbon black, channel carbon black, thermal carbon black, and acetylene carbon black. The content of carbon black is preferably 0.35–0.80 mass percentage.

Coloration of the above-described carbon black for the thermoplastic resin used for the present invention can be achieved by a compounding method or master-batch method of coloration described on pages 330–335 of, "A handbook of Plastic Processing Technology", issued by Nikkan Kogyo Shimbun, Ltd. In order to improve the light shielding, an embossing process is preferably performed on one or both of the surfaces of the flange of the light shielding flange member of the present invention. Though there is no limitation for the embossing process, enumerated are etching embossing, blast, and honing processes.

Concerning the effect of the production of the thin type light shielding flange member by injection molding, the hollow cylindrical boss section of the light shielding flange member was fixed into the hollow cylindrical inner section of the core without use of supplementary parts, the inner shaft of the magazine was fixed without loosening and was easily removed from the inner wall of hollow section of the hollow cylindrical boss section of the light shielding flange member, the production cost was inexpensive, production was stable, and thereby the ambient light loadable packaged photosensitive material could be easily produced and the operation rate was increased.

What is claimed is:

1. Paired light shielding flange members, each comprising:

a hollow cylindrical boss section to be inserted into a hollow cylindrical core around which a photosensitive material has been wound, wherein a plurality of rib sections are formed on an exterior surface of the hollow cylindrical boss section in parallel with an axis of the hollow cylindrical boss section, and an interior surface portion of each rib is grooved in parallel with the axis of the hollow cylindrical boss section; and a flange section, integrated concentrically with the hollow cylindrical boss section, to prevent an edge of the photosensitive material from being exposed to light.

2. The paired light shielding flange members of claim 1, having a thickness of 0.3–0.5 mm, which is formed by injection molding using a metal mold die having 3–6 submarine gates arranged adjacent to a center of an inner peripheral surface of a hollow cylindrical boss section of the metal mold die.

3. The paired light shielding flange members of claim 1, wherein flatness of an outermost circumferential surface of the flange section is −0.1–+0.3 mm, compared to a basic section of the hollow cylindrical boss section.

4. The paired light shielding flange members of claim 1, wherein 8–18 rib sections are formed on the surface of the hollow cylindrical boss section.

5. The paired light shielding flange members of claim 1, wherein a height of the rib section is 1.2–2.4 mm.

6. The paired light shielding flange members of claim 1, wherein a width of the rib section is 2.5–4.0 mm.

7. The paired light shielding flange members of claim 1, wherein a depth of the grooved section is equal to the height of the rib section.

8. The paired light shielding flange members of claim 1, wherein a greatest outer diameter of the hollow cylindrical boss section is 100.2–101.0% of an inner diameter of the core.

9. The paired light shielding flange members of claim 1, wherein a diameter of the flange section is 102–110% of the diameter of the rolled photosensitive material.

10. The paired light shielding flange members of claim 1, which are made of thermoplastic resin.

* * * * *